US008146891B2

(12) United States Patent
Giltner et al.

(10) Patent No.: US 8,146,891 B2
(45) Date of Patent: Apr. 3, 2012

(54) POWERED TOOL UTILIZING INTERCHANGEABLE DRIVER ASSEMBLIES FOR REMOVAL OF VARIOUS SIZED FASTENERS FROM A HOST MATERIAL

(75) Inventors: Jon X. Giltner, Boulder, CO (US); Wayne G. Johannes, Rocky Ford, CO (US)

(73) Assignee: Reconnx, Inc., Boulder, CO (US)

( * ) Notice: Subject to any disclaimer, the term of this patent is extended or adjusted under 35 U.S.C. 154(b) by 913 days.

(21) Appl. No.: 12/082,274

(22) Filed: Apr. 10, 2008

(65) Prior Publication Data

US 2009/0256122 A1 Oct. 15, 2009

(51) Int. Cl.
*B25C 11/00* (2006.01)

(52) U.S. Cl. ..... 254/18; 29/243.53; 29/243.54; 29/243.55

(58) Field of Classification Search ..... 254/18; 29/243.53, 243.54, 243.55
See application file for complete search history.

(56) References Cited

U.S. PATENT DOCUMENTS 4,365,401 A * 12/1982 Ogren ..... 29/243.53
5,141,205 A * 8/1992 Iwai et al. ..... 254/18
D336,026 S 6/1993 Fujiwara

OTHER PUBLICATIONS

Giltner et al, The Nail Kicker by Recnnx, Apr. 12, 2007, ReConnX, Inc., Denver, Colorado.

* cited by examiner

*Primary Examiner* — Lee D Wilson
*Assistant Examiner* — Shantese McDonald
(74) *Attorney, Agent, or Firm* — Harold A. Burdick

(57) ABSTRACT

Powered tools and interchangeable driver assemblies for removal of fasteners from a host material are disclosed. The tool includes a housing having a chamber operatively associated with an actuator assembly. Interchangeable driver assemblies may be provided that include a plurality of interchangeable particularly configured drive pins and a plurality of interchangeable guide elements, each guide element selectively adapted for use with a different one of the drive pins. The guide element has an elongate central passage therethrough, is receivable by a mount releasably maintained at the housing adjacent the chamber, and may be configured for slidable retention thereat. In such case, the guide element is biased toward a fully extended position and is slidable between the fully extended position and a retracted position.

19 Claims, 17 Drawing Sheets

POWERED TOOL UTILIZING INTERCHANGEABLE DRIVER ASSEMBLIES FOR REMOVAL OF VARIOUS SIZED FASTENERS FROM A HOST MATERIAL

FIELD OF THE INVENTION

This invention relates to devices for removal of driven fasteners from yieldable host materials, and, more particularly, relates to powered devices utilizing impact for nail removal from a host.

BACKGROUND OF THE INVENTION

Nails and similar such driven fasteners (brads, spikes, staples, screws and the like) have long been utilized for fastening, including fastening combinations of wood and other materials such as plastic, metal composites and resinous materials. Such fasteners have been and will continue to be made of a variety of materials and in a variety of shapes and sizes to meet the needs of a wide range of applications. Powered nailers (gas and pneumatic) have been introduced to enhance worker productivity and enhance ease of nail installation.

Nails are easily as difficult to remove as they are to install. Over time, such fasteners are subject to wide variations in local conditions that change the bond between the nail and host material. Moreover, coatings and shank configurations have been increasingly utilized to maximize withdrawal resistance. Thus, hundreds, and often thousands, of pounds of force are required to withdraw nails from wood (the most common host material). Heretofore, the most common removal tools have been hand tools with claws that either hook under fastener heads or grip their shanks to enable the fasteners to be pried from the host material.

More recently, devices utilizing pneumatic nailer technology have been introduced for removal of nails (see, for example, U.S. Pat. Nos. 5,141,205 and Des. 336,026). In operation these devices (often referred to as "denailers") receive a portion of a nail protruding from a surface in a bore for straightening and subsequent impact removal utilizing a drive pin extendable through and from the bore. These devices have been successful where the tool bore and pin size (diameter and length) are well matched to the nail size. However, when not well matched, nail displacement may be relatively inefficient.

For a given driving force, it has been found that nail displacement per impact is improved dramatically where drive pin diameter more closely matches the diameter of the nail shank. Therefore, a denailer with considerably more driving force and a large drive pin diameter may not perform well on smaller nails. In addition, prior to impact, the specific distance the nail protrudes into the tool bore affects the eventual distance the nail is displaced. In one tool model tested, a nail protrusion of 16 mm produced greater nail displacement than smaller or larger insertion distances. Finally, during impact the drive pin flexes inside the guide bore which braces the pin. Buckling and bending stresses on the drive pin increase dramatically when protruding outside the bore, and increase as the protruded and unbraced length of the drive pin increases. Heretofore known denailers establish the bore and pin length (and thus protrusion distance) for all cases, thereby subjecting the driver to such buckling stresses even in applications where driver pin protrusion is not needed at all.

Most heretofore known and/or utilized powered denailers are currently configured so that the driver pins protrude from the tool during operation. Given the forces involved, safety considerations would dictate improvement here. Providing a trigger locking device linked to contact with the host material has heretofore proven difficult due to likely interference with nail-straightening operations and/or difficult or crowded work surfaces. One heretofore known tool provided a trigger lock that required user activation. Typically, users either forget to, or choose not to, use this lock routinely. Another manufacturer has provided a spring-loaded secondary trigger that flips into place after the primary trigger is released, locking the primary trigger passively until the secondary trigger is first depressed. In the field it has been observed that the secondary trigger, almost without exception, has been removed or disabled by users.

As may be appreciated from the foregoing, further improvement in powered denailer devices could thus still be utilized, particularly addressing driver durability, flexibility of tool utilization in the field, and safety concerns.

SUMMARY OF THE INVENTION

This invention provides improved powered nail extracting apparatus utilizing impact for nail extraction (such apparatus are typically gas powered, e.g., pressurized air tools or the like, and are often referred to as denailers). This invention provides a powered tool utilizing interchangeable driver assemblies for optimization of removal of fasteners of different sizes and/or character from a host material such as wood or combinations with other materials such as another wood layer, plastic, soft metals or the like. This invention also provides a powered nail extracting tool wherein the nail extracting drive pin is shielded during use by a guide element slidable between a fully extended position and a retracted position established by contacting the host material. The tools and assemblies of this invention provide greater fastener extracting drive pin durability, flexibility of tool utilization in the field, and/or enhanced operator safety.

The tool of this invention provides multiple driver choices that enable a single denailer to be effective with a wide range of fastener/nail sizes and character. The retractable guide element provides convenient and passive driver guard. Various means for selecting extent of, or locking out, guide element movement, if desired, may be provided. Together, improved operational techniques and increased worker productivity and safety are provided.

In accord with one aspect of this invention, the powered tool includes a tool housing having a chamber operatively associated with an actuator assembly (gas powered, for example pneumatically activated, though other means of motive force could be utilized). Interchangeable driver assemblies are provided that include a plurality of interchangeable drive pins and a plurality of interchangeable guide elements. Each of the guide elements is selectively adapted for use with a different one of the drive pins.

The provided drive pins each have a particularly configured end that is at least a different diameter and/or a different length from any other of drive pin, thus adapted for removal of selected driven fasteners of particular sizes or characters from a host material. An opposite end of a selected one of the drive pins is mountable in the chamber of the tool housing and movable therein responsive to the actuator assembly. A guide portion is releasably maintained at the tool housing in communication with the chamber. A selected one of the plurality of guide elements adapted for use with the selected drive pin is mountable on the guide portion thus also in communication with the chamber, and receives therethrough the particularly configured end of the selected drive pin.

Using the interchangeable driver assemblies, a different selected one of the plurality of drive pins together with a different selectively adapted one of the plurality of guide elements may be installed at the denailing apparatus when selected fasteners of a particular size or character are encountered, and changed as still other fasteners of a different character are encountered.

In accord with another aspect of this invention, the guide portion of the denailing tool includes a mount releasably maintained at the housing in communication with the chamber. The guide element has an elongate central passage therethrough receivable by the mount and slidably retained thereat, the guide element slidable between a fully extended position and a retracted position. The guide element is biased toward the fully extended position. The drive pin is protrusible through and from the elongate passage of the guide element when the guide element is moved to the retracted position and the actuator assembly is activated. Interchangeable driver assemblies may or may not be made available in this case, though such is preferred.

It is therefore an object of this invention to provide improved powered nail extracting apparatus utilizing impact for nail extraction.

It is another object of this invention to provide a powered tool utilizing interchangeable driver assemblies for optimization of removal of fasteners of different sizes and/or character from a host material.

It is still another object of this invention to provide interchangeable driver assemblies for a powered denailing apparatus.

It is yet another object of this invention to provide a powered nail extracting tool wherein a nail extracting drive pin is shielded during use by a retractable guide element.

It is still another object of this invention to make available driven fastener removal tools and assemblies providing greater fastener impacting drive pin durability, greater flexibility of use in the field for removal of a variety of fastener types and sizes, and/or enhanced operator safety.

It is yet another object of this invention to provide a denailing tool that improves operational techniques and thus increases worker productivity and safety.

It is another object of this invention to provide a powered tool for removal of various sized fasteners from a host material that includes a tool housing having a chamber operatively associated with an actuator assembly, and interchangeable driver assemblies including a plurality of interchangeable drive pins and a guide portion having a plurality of interchangeable guide elements each selectively adapted for use with a different one of the plurality of drive pins, each of the plurality of drive pins having first and second ends, each of the second ends having at least one of a different diameter and a different length from any other second end of the plurality of drive pins, any selected one of the plurality of drive pins mountable with the first end thereof in the chamber of the tool housing and movable therein responsive to the actuator assembly, the guide portion releasably maintained at the tool housing and in communication with the chamber, a selected one of the plurality of guide elements mountable thereon for receipt therethrough of the second end of the selected one of the plurality of drive pins.

It is still another object of this invention to provide interchangeable driver assemblies for a powered denailing apparatus, each assembly adapted for removal of selected driven fasteners of particular sizes or characters from a host material, the denailing apparatus having a chamber operatively associated with an actuator assembly, the assemblies including a plurality of interchangeable drive pins each having an end portion having at least one of a different diameter and a different length from any other end portion of the plurality of drive pins, a selected one of the plurality of drive pins mountable in the chamber of the denailing apparatus for movement therein responsive to the actuator assembly, and a plurality of interchangeable guide elements each selectively adapted for use with a different one of the plurality of drive pins, a selectively adapted one of the plurality of guide elements receivable at the denailing apparatus in communication with the chamber thereof for receipt therethrough of the end portion of the selected one of the plurality of drive pins, wherein a different selected one of the plurality of drive pins together with a different selectively adapted one of the plurality of guide elements may be installed at the denailing apparatus when selected fasteners of a different size or character are encountered.

It is yet another object of this invention to provide a denailing tool for removal of nails from a host material that includes a housing having a chamber operatively associated with an actuator assembly, a guide portion including a mount releasably maintained at the housing in communication with the chamber thereof and a guide element having an elongate central passage therethrough receivable by the mount and slidably retained thereat, the guide element slidable between a fully extended position and a retracted position and biased toward the fully extended position, and a drive pin having first and second ends, the first end positionable in the chamber of the housing and movable therein responsive to activation of the actuator assembly and the second end receivable at the guide portion and protrusible through and from the elongate passage of the guide element when the guide element is moved to the retracted position and the actuator assembly is activated.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
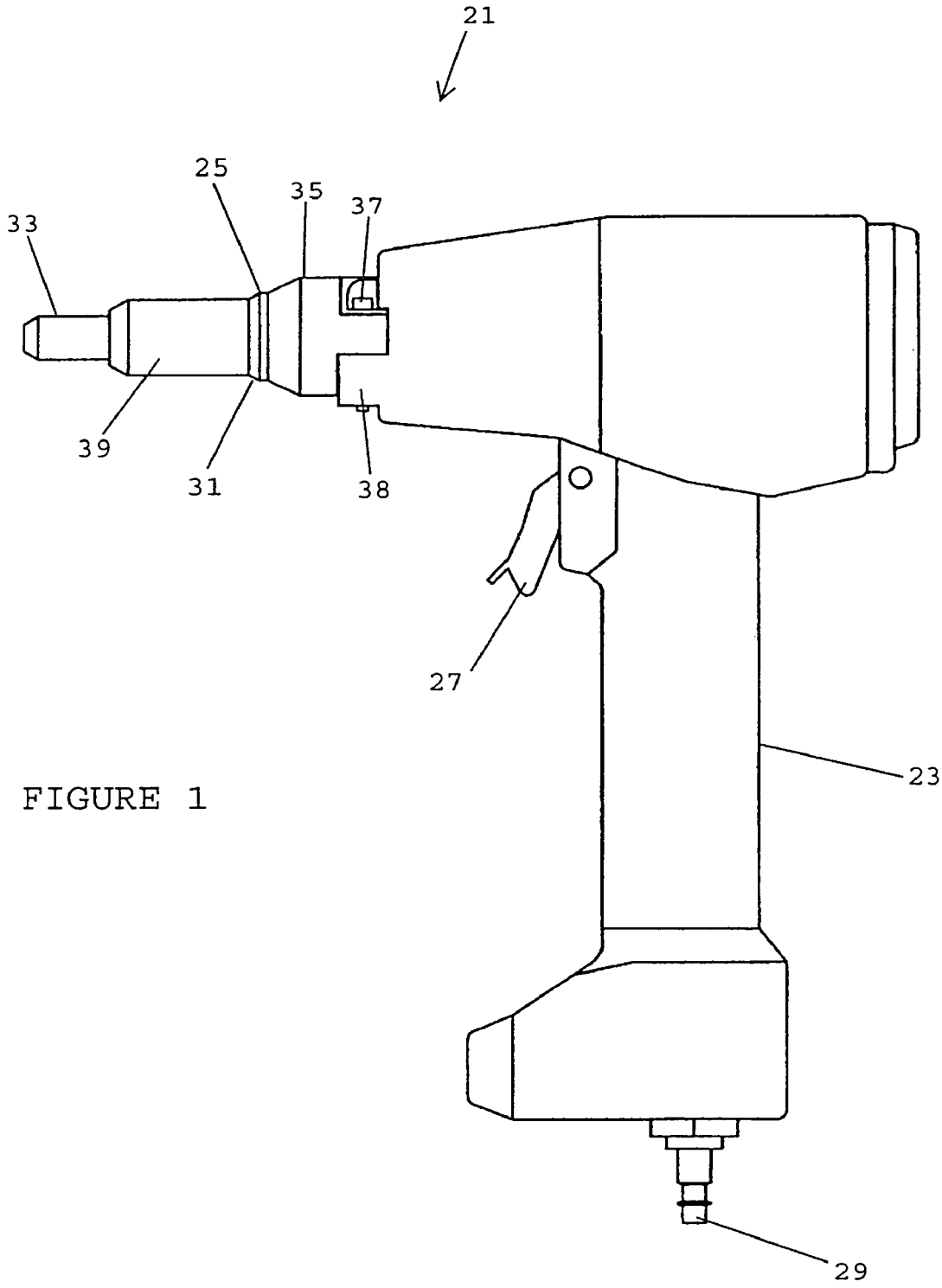
FIG. 1 is a side elevation view of a gas powered (in this case pneumatic) tool in combination with the guide portion of FIG. 1 in accord with this invention.
Figure 2:
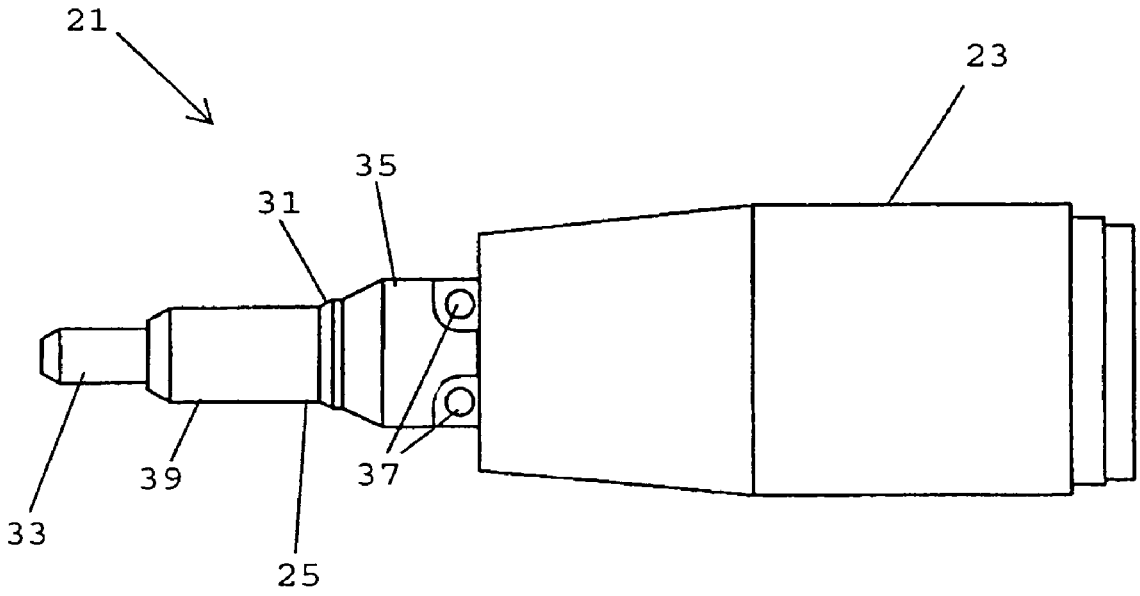
FIG. 2 is a top elevation view of the combined tool of FIG. 2.
Figure 3:
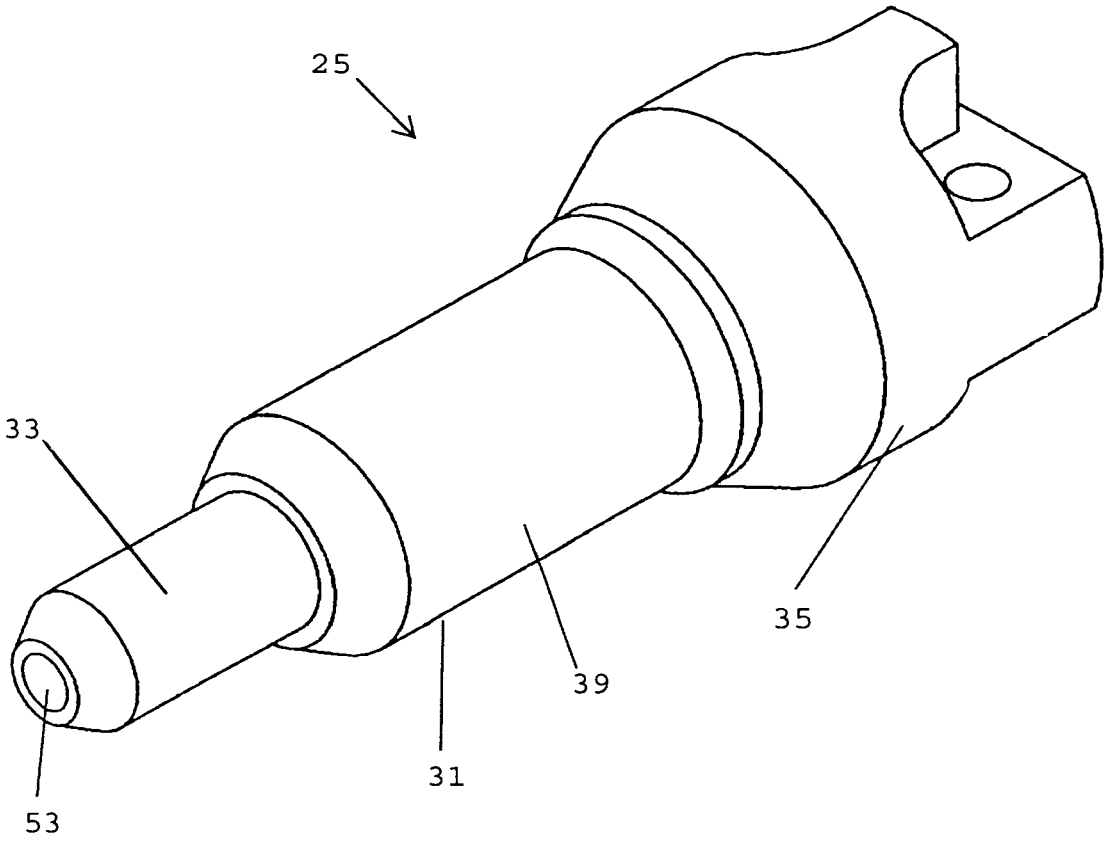
FIG. 3 is a perspective view of a first embodiment of a guide portion of an interchangeable driver assembly of this invention.

A first embodiment 21 of the powered tool (a denailing apparatus, for example) of this invention for removal of various sized fasteners from a host material is illustrated in FIGS. 1 through 7D. Tool 21 includes tool housing 23 and a guide portion 25. Housing 23 includes an actuator assembly (discussed more fully hereinafter) having an activating trigger assembly 27 and pressurized gas inlet connector 29 interrelated as known in the art (while gas activation is shown in the FIGURES—a pneumatic air systems, for example—, it should be appreciated that other systems for applying motive force appropriate to the tasks could be utilized herein).

Figure 5:
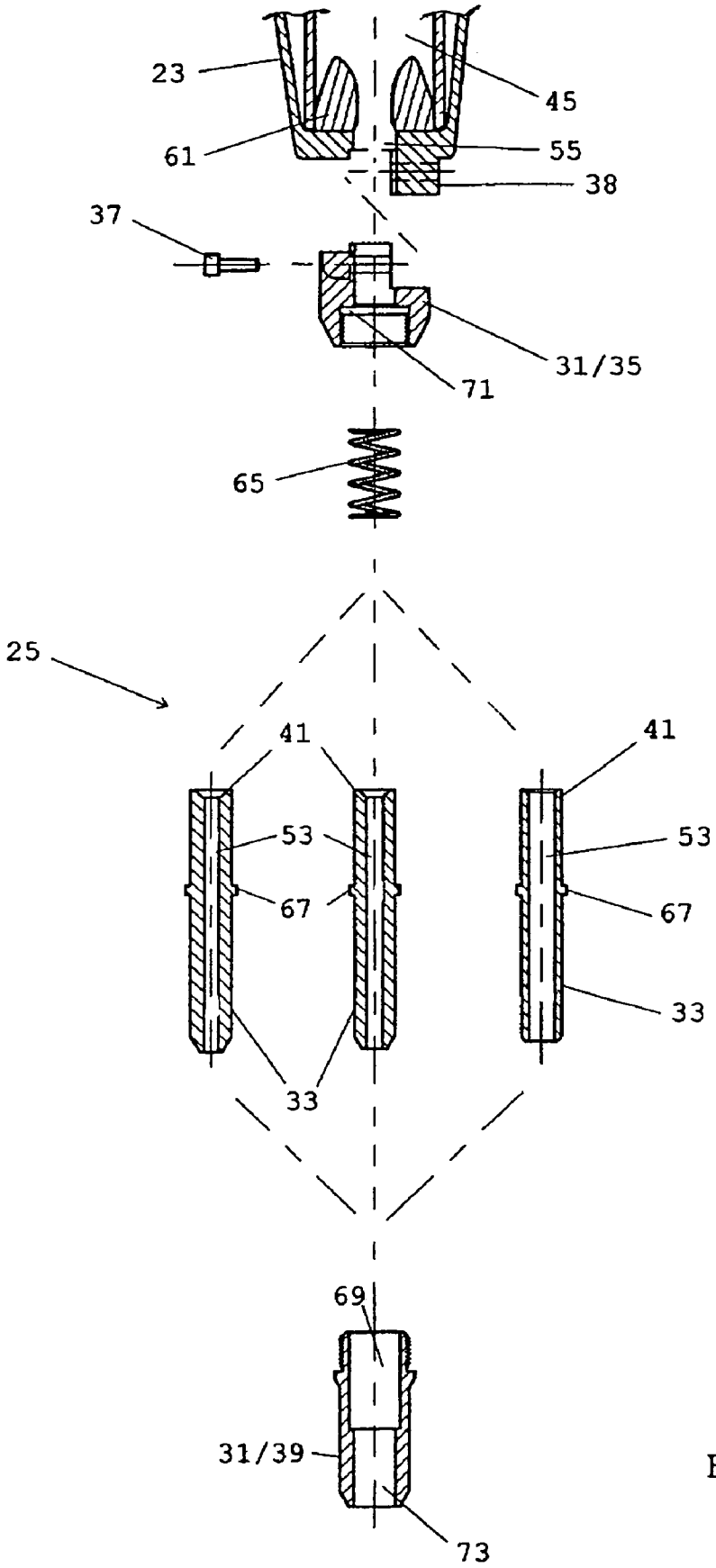
FIG. 5 is an exploded sectional view illustrating the interchangeability of guide elements of the guide portion of the driver assembly of FIG. 1 adapted for use with the various sized drive pins illustrated in FIG. 4.
Figure 6:
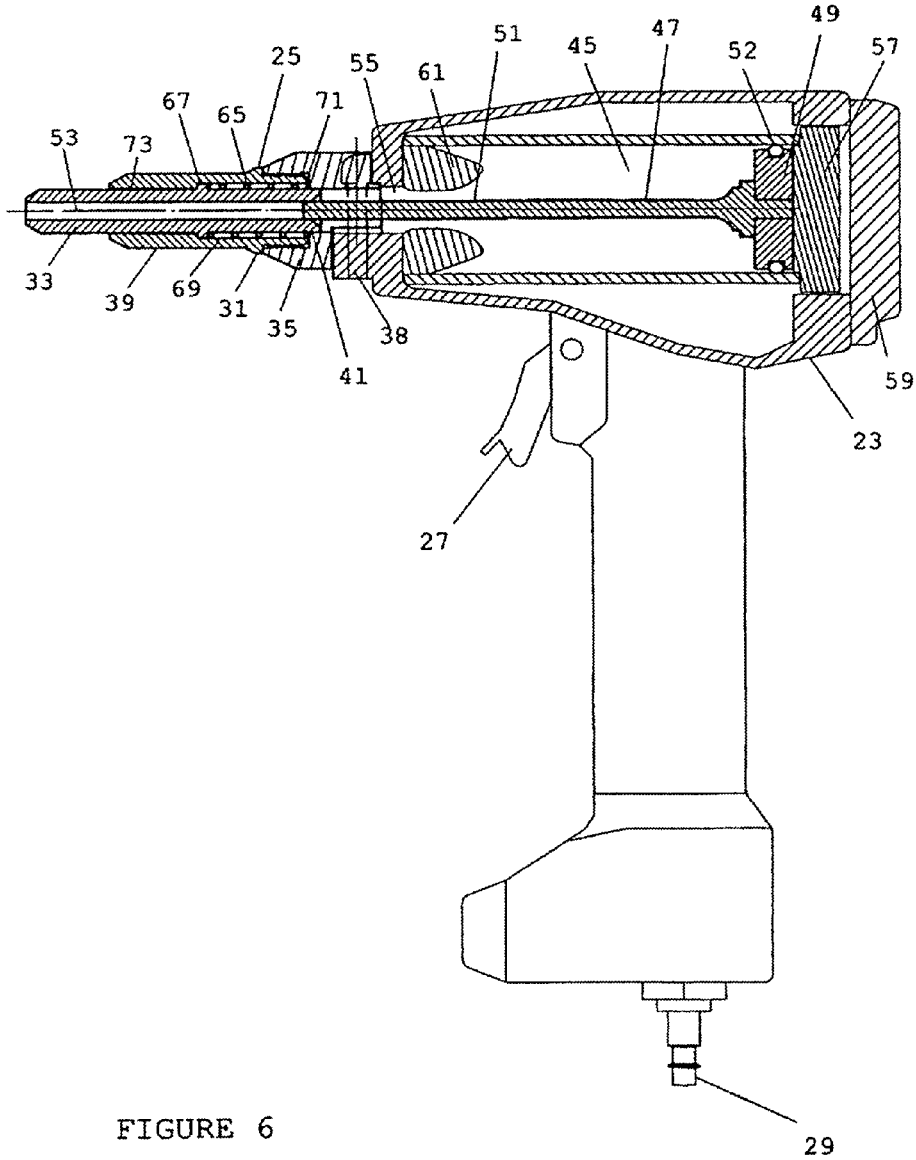
FIG. 6 is a side, partially sectional, view of the combined tool of FIG. 2.

In accord with one aspect of this invention, interchangeable driver assemblies are provided each adapted for removal of selected driven fasteners of particular sizes or characters from a host material. The assemblies include guide portion 25 having mount assembly 31 and a plurality of interchangeable guide elements 33 interchangeably secured in mount assembly 31. Mount assembly 31 includes mount base 35 releasably maintained on housing 23 by mounting bolts 37 therethrough and received at housing mounting block 38. Retainer 39 of mount assembly 31 is releasably securable to base 35 (by matable threads for example as shown in FIGS. 5 and 6). A selected guide element 33 is receivable at end 41 thereof at mount base 37 (see FIGS. 5 and 6) and through retainer 39.

Figure 4:
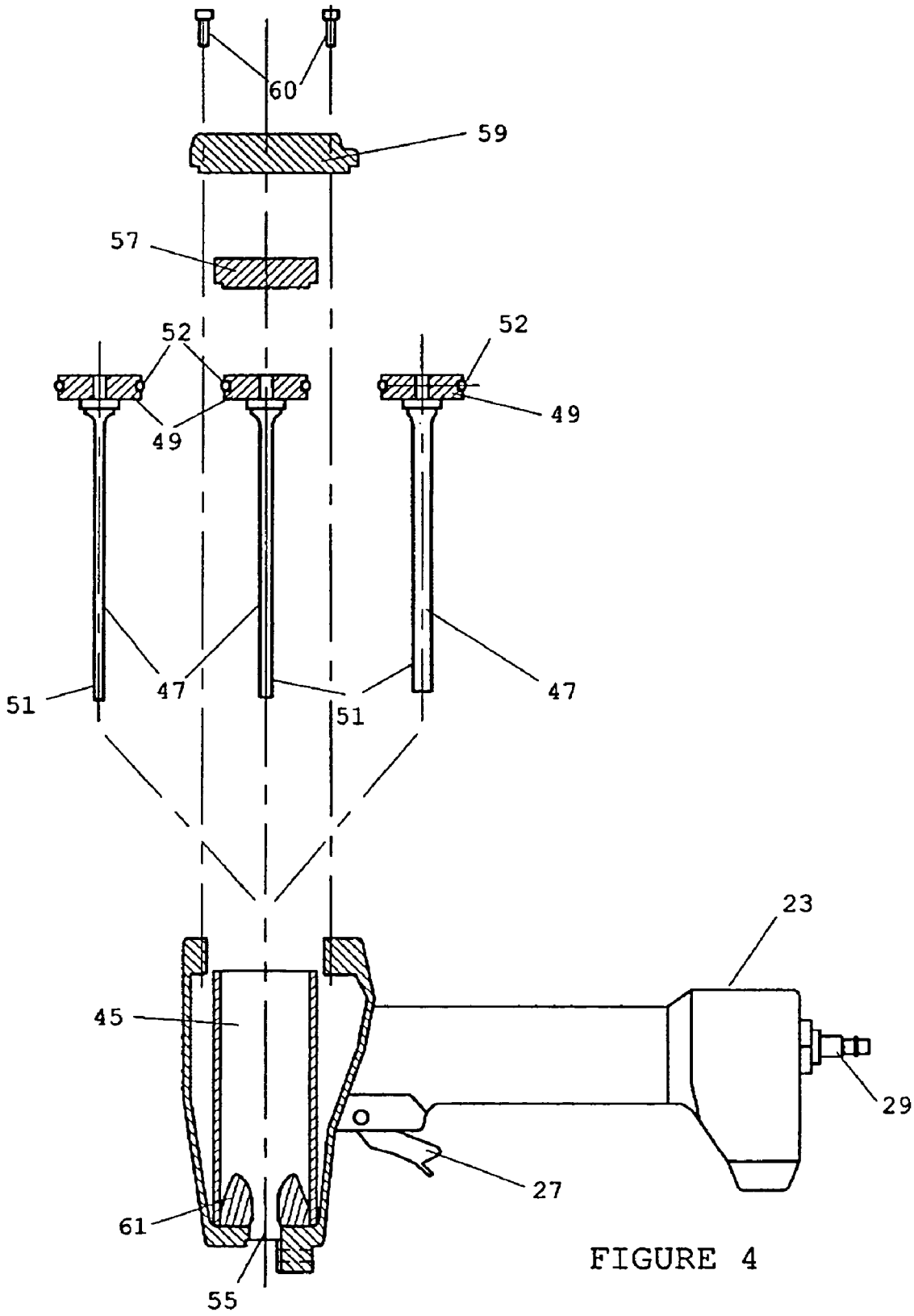
FIG. 4 is a sectional illustration of interchangeable drive pins of the interchangeable driver assemblies of this invention adapted for use in the tool of FIG. 2.

Turning to FIGS. 4 and 5, tool housing 23 has chamber 45 (typically a defined by cylinder in pneumatic systems) operatively associated with the actuator assembly. The interchangeable drive assemblies also include a plurality of interchangeable drive pins 47 are provided, each having first and second ends 49 and 51, respectively. Ends 49 are configured as pistons with seals 52 to sealingly engage the walls of chamber 45. Each of ends 51 of the different drive pins 47 has a different, substantially constant diameter and/or a different length from any other pin 47 particularly configured for use in removal of particular fastener types, sizes or characteristics (three are shown, though fewer or more could be provided). The plurality of interchangeable guide portions 33 are each in turn selectively adapted for use with a different one of the plurality of drive pins 47 (having internal passages 53 with different diameters and/or lengths selected to properly and safely support pins 47).

A selected one of the plurality of drive pins 47 is mountable with first end 49 in chamber 45 of tool housing 23 and second end 51 extending through opening 55 at an end of chamber 45 (which communicates therethrough with guide portion 25—see FIG. 6) and into the internal passage of the guide elements 33 selectively adapted thereto. Chamber end seal 57 closes and seals chamber 45, and housing end cap 59 closes and seals the housing using any known connector or connectors 60. The selected pin 47 is thus movable in chamber 45 responsive to the actuator assembly as more fully described hereinafter. In this manner, different ones of the plurality of drive pins 47 together with their mated selectively adapted guide elements 33 may be installed when selected fasteners of different sizes or characters are encountered. Moreover, these elements could be used alone or in combination in some cases.

In a typical pneumatic system of this type, compressed air is received from a source through connector 29. When trigger assembly 27 is pulled, air is suddenly introduced a cavity in communication with chamber 45 behind piston end 49 as is known. The bond between piston end 49 and driver end 51 of drive pins 47 is very high strength and resistant to shock and vibration. Drive pin 47 is forcefully pushed forward by the introduced air. At the end of chamber 45 (and the full available travel of pin 47), some or all of the energy and momentum of pin 47 is absorbed by bumper 61 adjacent to opening 55. After the stroke, the chamber is exhausted and the pin returned utilizing known techniques.

In accord with another aspect of this invention, guide elements 33 are adapted for retractability during use by pressing the installed guide element 33 against a work surface (the host material from which the fastener/nail is being removed) during the process of removal. While preferred, this aspect of the invention may not be utilized in some applications, in which case guide elements 33 would normally be of a length allowing drive pins 47 to protrude therefrom a selected distance during fastener removal operations.

Figure 7A:
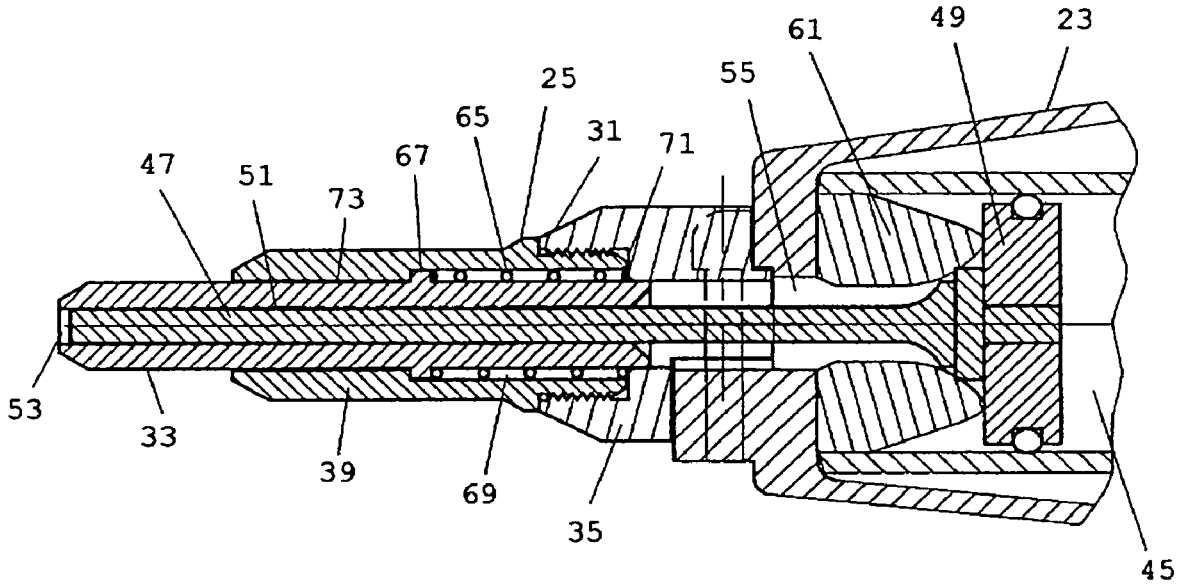
FIGS. 7A through 7D are partial side sectional views in accord with FIG. 6 illustrating various operational capabilities of the combined tool of FIG. 2.
Figure 7B:
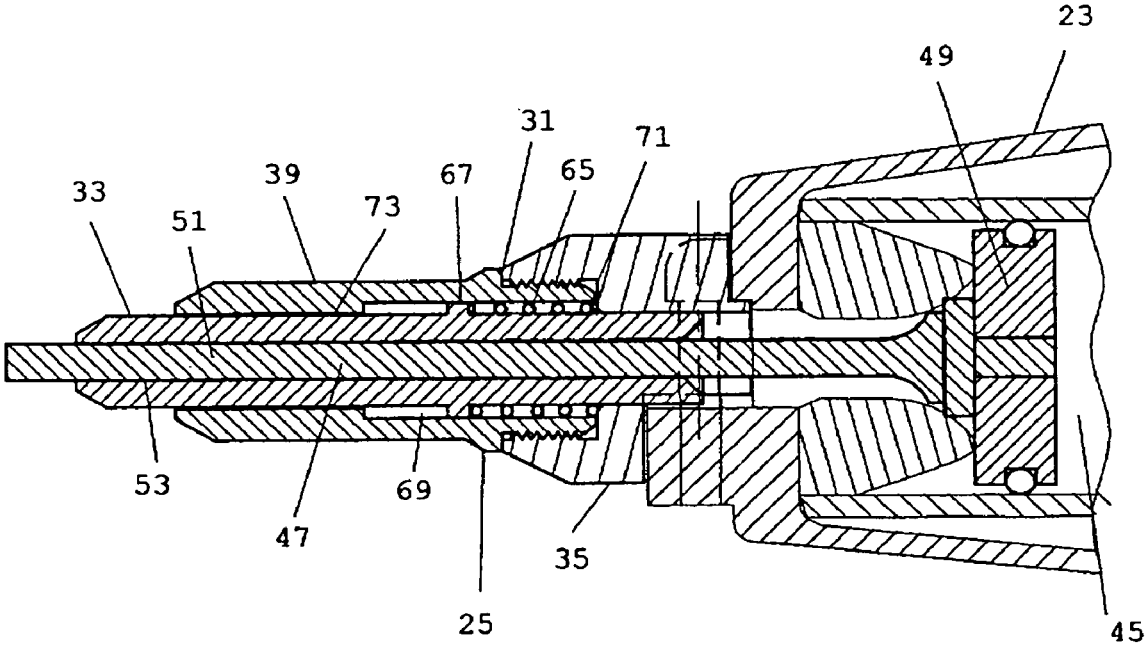
Figure 7C:
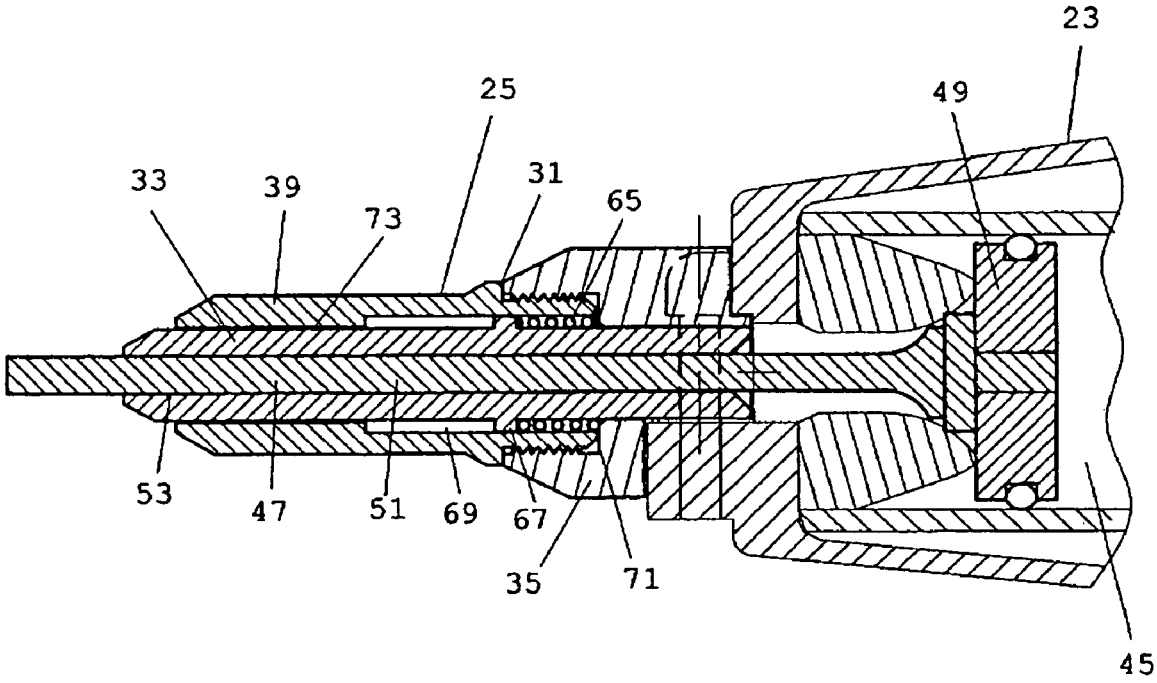
Figure 7D:
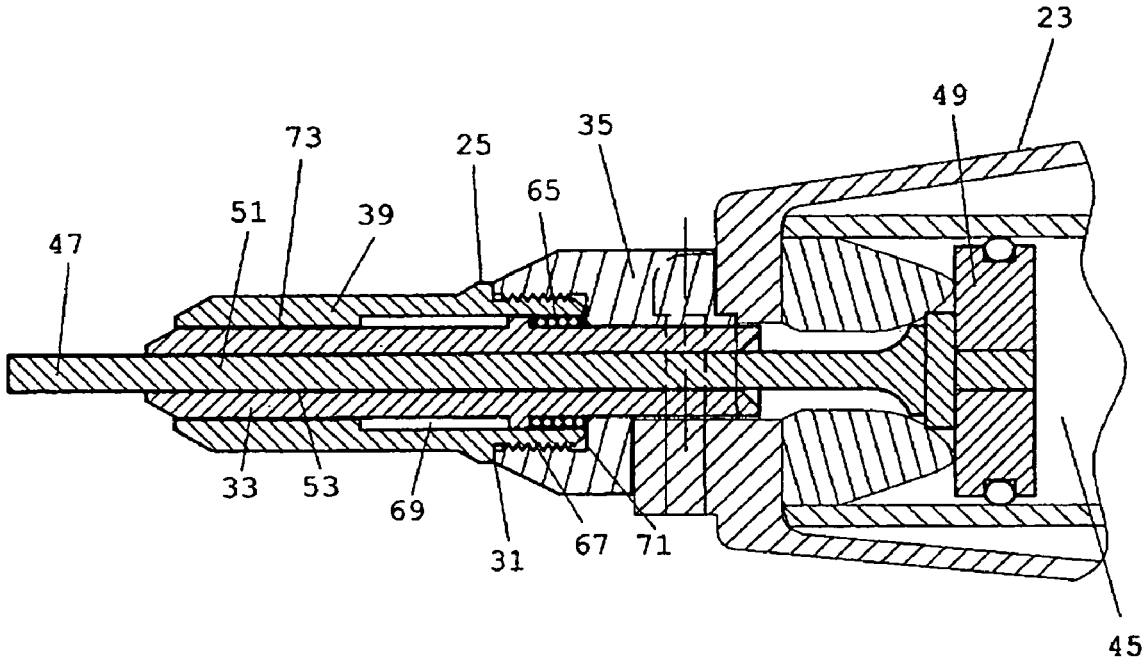
Figure 8:
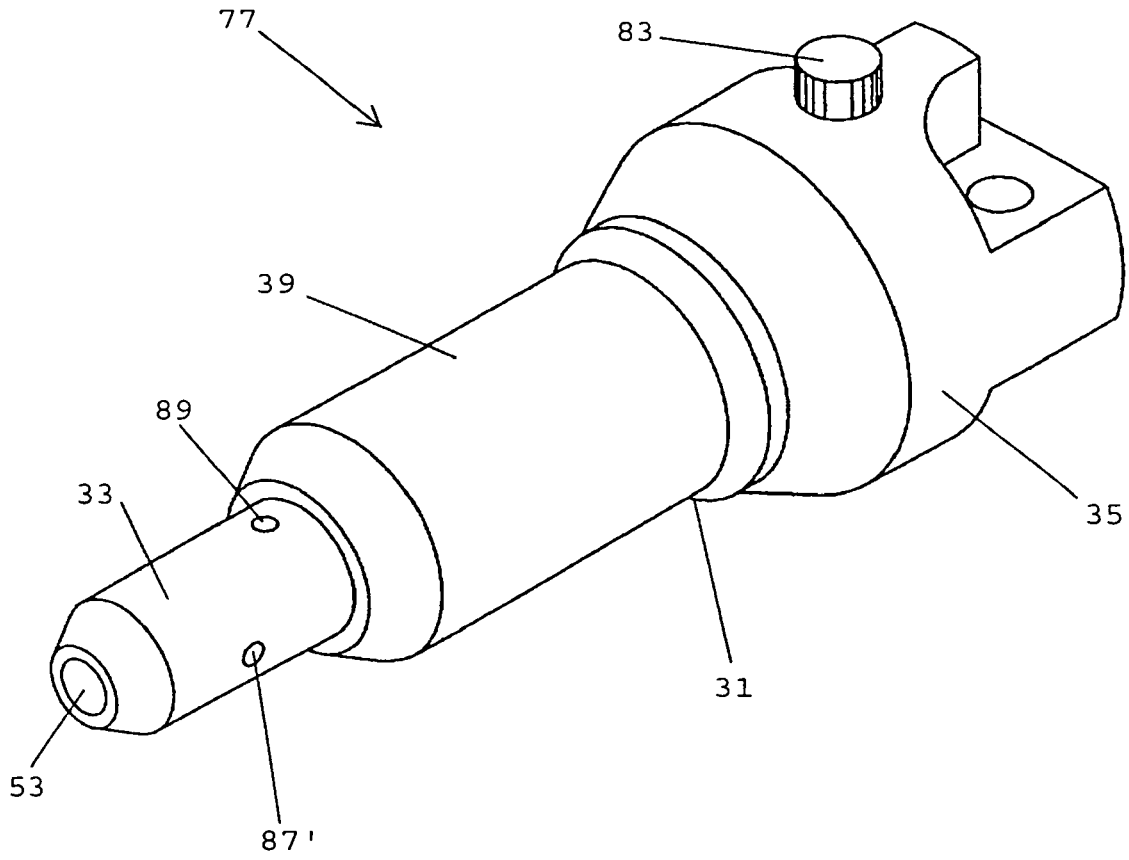
FIG. 8 is a perspective view of a second embodiment of a guide portion of an interchangeable driver assembly of this invention adaptable for use with various sized drive pins as illustrated in FIG. 4.
Figure 9:
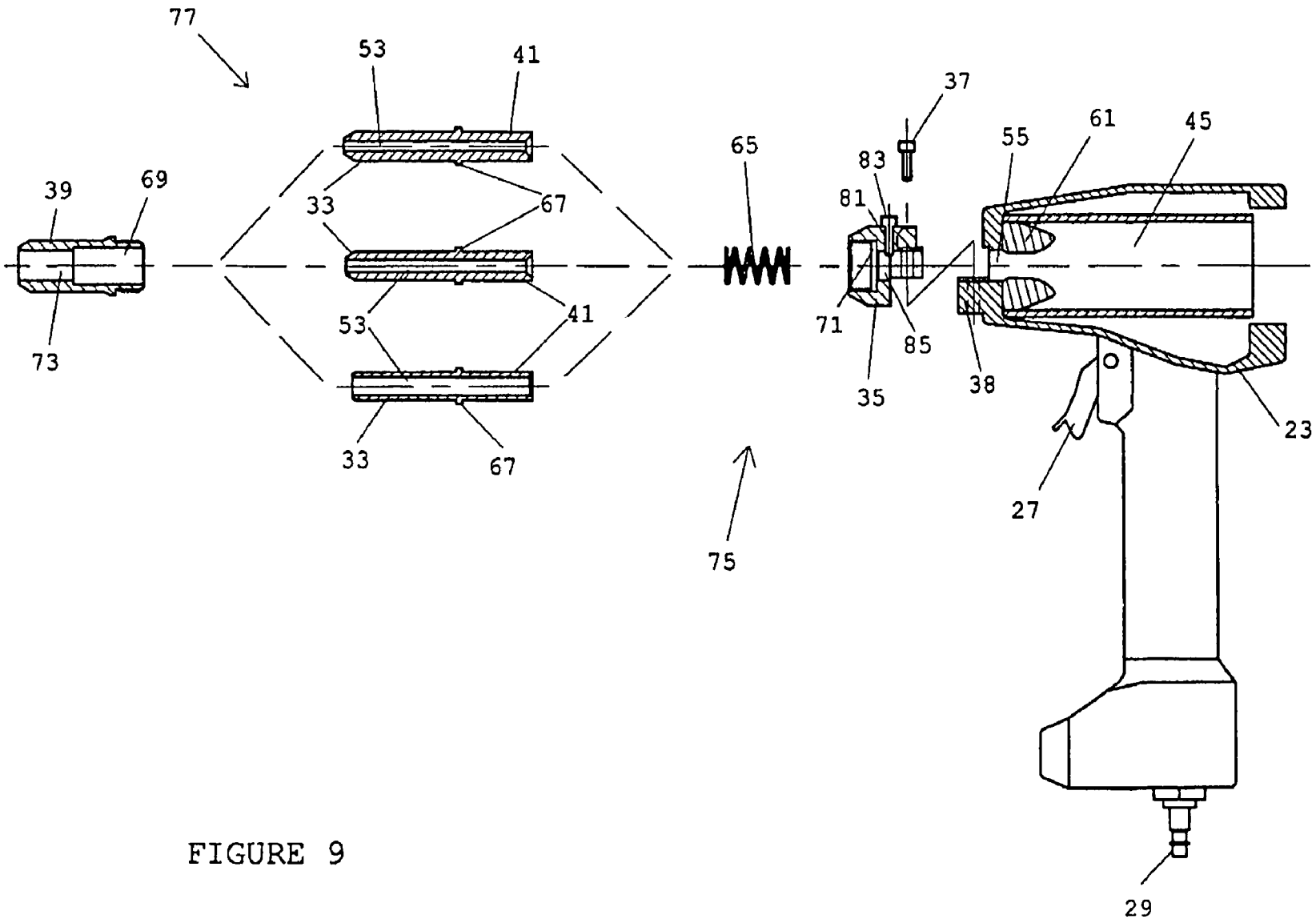
FIG. 9 is a partial exploded sectional view illustrating the interchangeability of guide elements of the guide portion of the driver assembly of FIG. 8 in combination with a powered tool and adapted for use with the various sized drive pins illustrated in FIG. 4.

As shown in FIGS. 5 through 7D, guide element 33 of guide portion 25 is slidable between a fully extended position relative to tool housing 23 and a retracted position toward the tool housing retracted into mount assembly 31, spring 65 mounted about guide element 33 biasing the guide element toward the fully extended position shown in FIG. 6. Spring 65 is relatively stiff, resisting all but the intentionally applied force exerted by a user against a host material during fastener removal operations. As will be appreciated, drive pin 47 is thus protrusible through and from elongate passage 53 of guide element 33 when the guide element is moved to the retracted position and the actuator assembly is activated as shown in FIGS. 7B through 7D, but otherwise does not protrude from passage 53 (for example, in case of accidental discharge).

Guide element 33 includes an external intermediate annular shoulder 67 slidable in larger internal bore segment 69 of retainer 39 which is adjacent to mount base 35 when retainer 39 is secured thereat. Mount base 35 has an internal shoulder 71 therein which both seats retainer 39 and one end of spring 65. Guide element 33 is preferably cylindrical having a primary external diameter, and retainer 39 has another bore segment 73 smaller than bore segment 69. The diameter of bore segment 73 is selected for slidable receipt and guidance of a guide element 33 along its primary external diameter. Spring 65 after assembly is located between shoulders 67 and 71 for biasing guide element 33 to the fully extended position.

In accord with this retractable guide element aspect of the invention, elongate central passage 53 of each guide element 33 has a length adapted to prevent protrusion therefrom of end 51 of drive pins 47 upon activation of the actuator assembly when not positioned and pressed against the host material thus causing retraction of guide element 33 (see FIG. 7A). When pressed against the host material adjacent to a fastener (the fastener end may be inserted inside passage 53 in varying amounts or below the surface of the host material), various amounts of guide element 33 retraction result in varying distances of protrusion of drive pin 47 from the end of guide element 33 (see FIGS. 7B through 7D).

Turning now to FIGS. 8 through 14, a second embodiment 75 of the powered tool of this invention is illustrated. Many of the elements of this embodiment are identical to or modified versions of those previously described, and in such cases the same identifying numbers are utilized, this description being drawn to the distinguishing features. Guide portion 77 has been adapted for selectively delimiting extent of travel of retractable guide elements 33 between the fully extended position and the retracted position or otherwise effecting retractability. As shown in the FIGURES, various external longitudinal grooves 79' and 79" (FIGS. 12 and 13, respectively) of particular lengths are located on guide element 33 adjacent to end 41 thereof. Base 35 of mount assembly 31 includes a threaded opening 81 therethrough for receipt and manipulation of manipulable member 83 (any manipulable screw or pin-type structure would be suitable), member 83 having a length sufficient to extend into opening 85 of base 35. Grooves 79' and 79" have associated location markers 87' and 87" (respectively) applied at guide element 33, together with one or more other functional markers 89 (see FIG. 8), element 33 being rotatable in mount 31 to locate the member 83 as desired relative to guide element 33.

Figure 10:
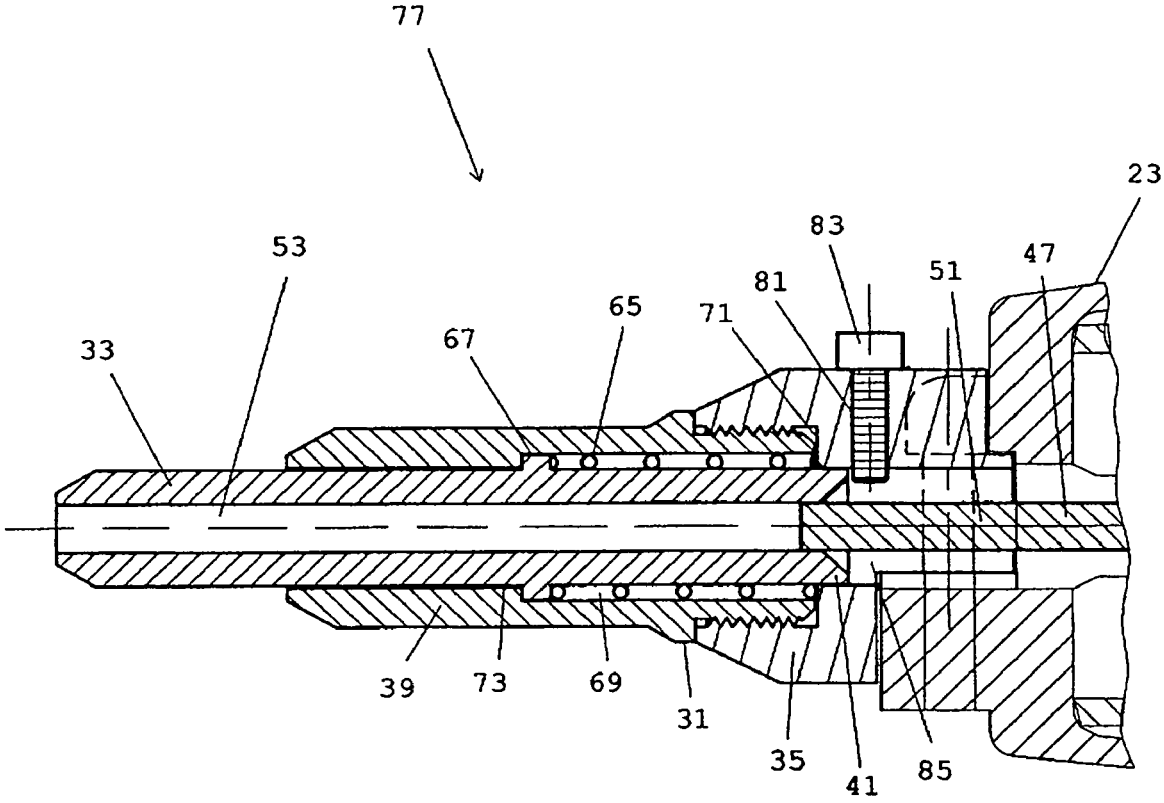
FIGS. 10 through 14 are partial side sectional views illustrating various operational capabilities of the combined tool utilizing the retractable guide portion embodiment of FIG. 8.
Figure 11:
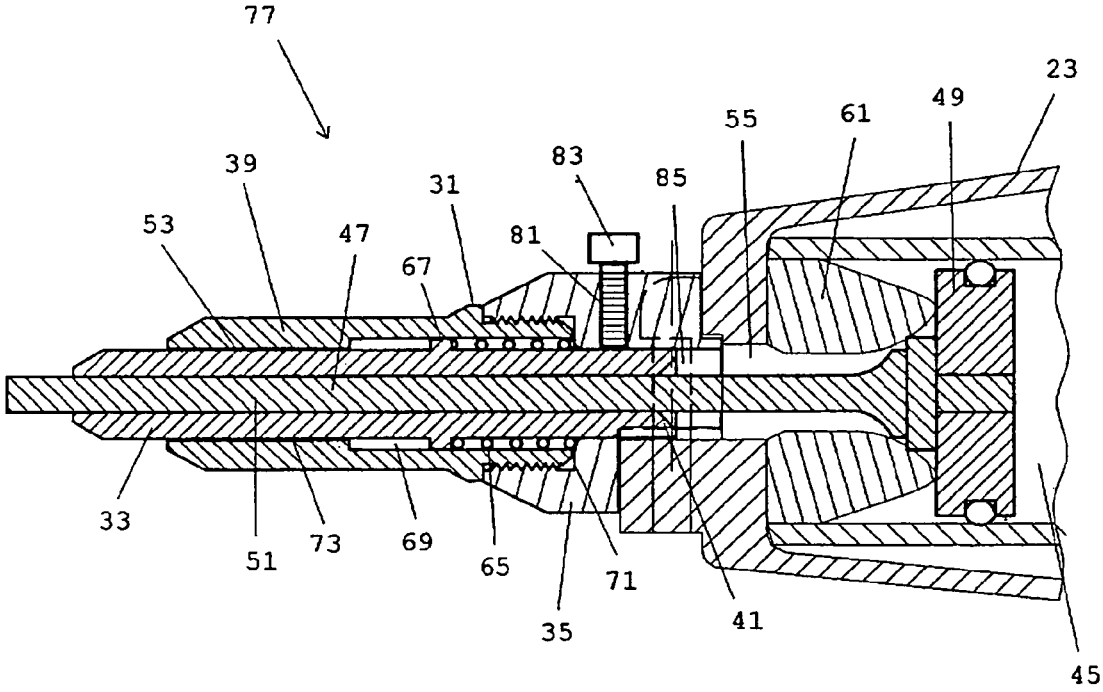
Figure 12:
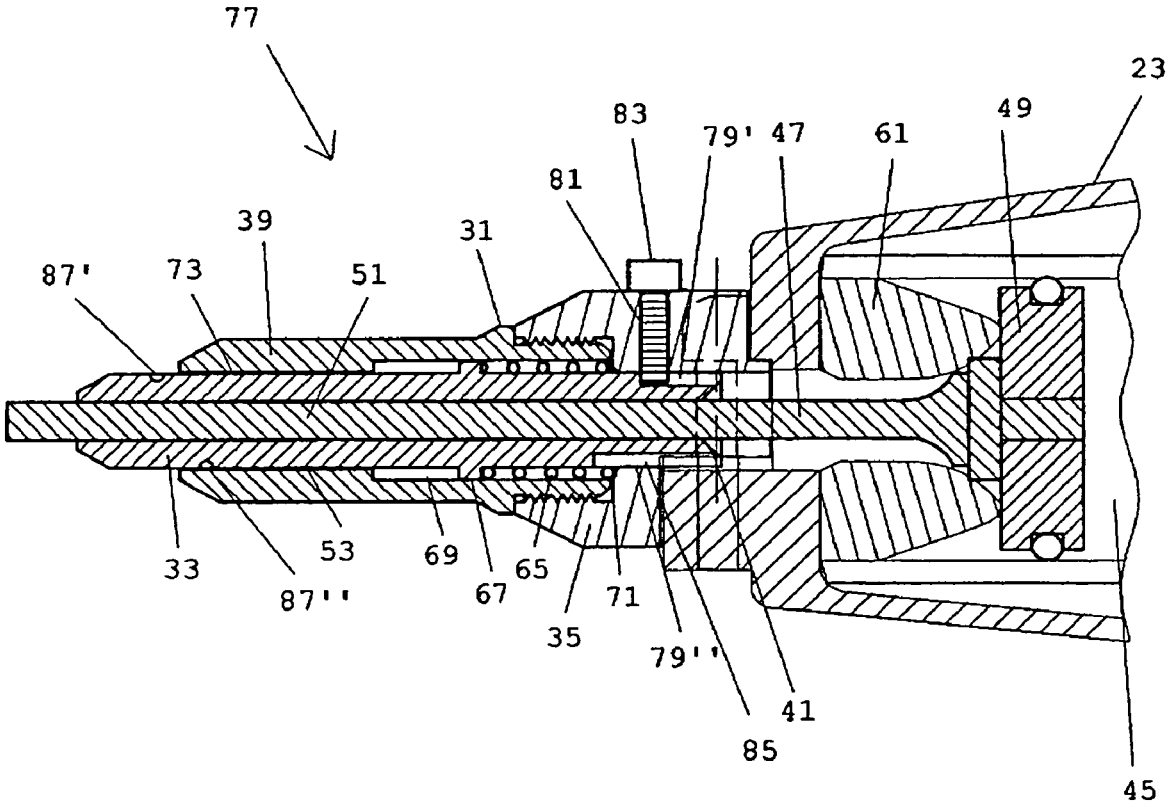

As shown in FIGS. 10 through 14, when guide element 33 is turned to a position with one of the other functional markers 89 aligned with member 83, if member 83 is fully inserted into opening 85 of base 35 no retraction of guide element 33 is possible (as shown in FIG. 10). When member 83 is moved out of opening 85 of base 35 (as shown in FIG. 11) or removed altogether, guide member 33 is freely retractable to its full extent much as heretofore described. When guide element 33 is turned to a position with marker 87' aligned with member 83, if member 83 is then fully inserted into opening 85 it will engage in groove 79' thus delimiting extent of travel of retractable guide element 33 between the fully extended position and a limited retracted position with member 83 abutting the end of groove 79' (see FIG. 12).

Figure 13:
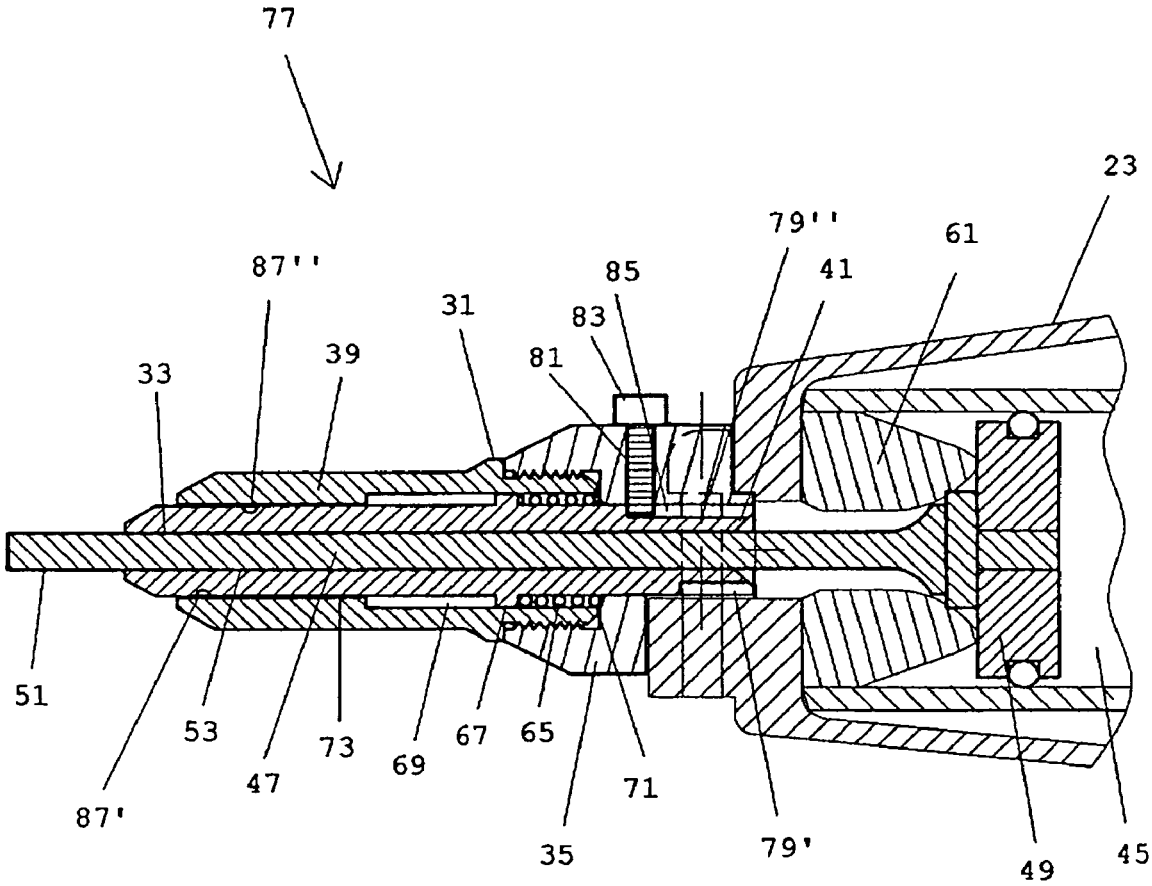
Figure 14:
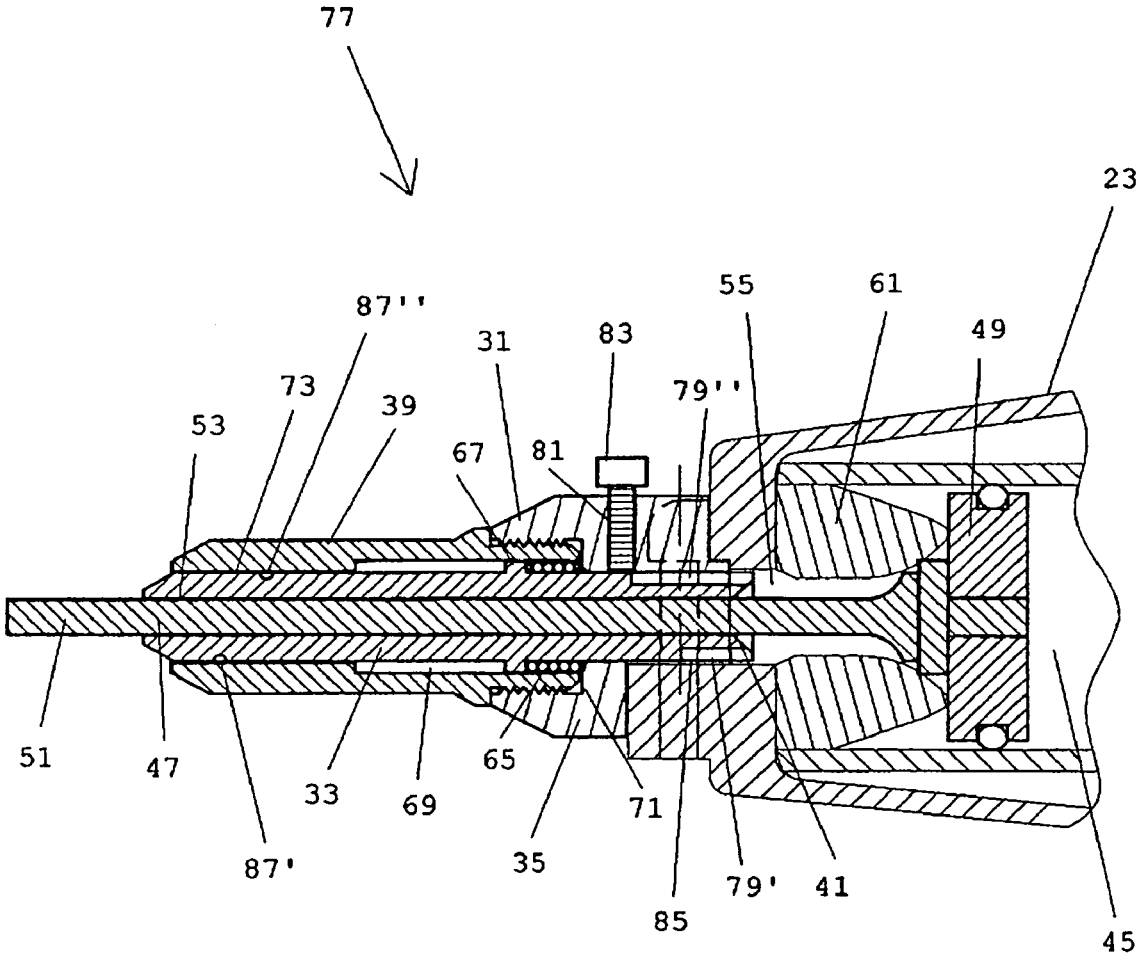

When guide element 33 is turned to a position with marker 87" aligned with member 83, if member 83 is then fully inserted into opening 85 it will engage in groove 79" thus delimiting extent of travel of retractable guide element 33 between the fully extended position and a further, but still limited, retracted position with member 83 abutting the end of groove 79" (see FIG. 13). Member 83 can also be tightened to grip element 33 anywhere along its length, thereby halting movement thereof and thus essentially locking out further retractability (see FIG. 14).

As may be appreciated, pins 47 are made of hardened metal. Mount assembly 31 may be made of any durable material equal to the task, preferably metal, while tool housing 23 is constructed of selected materials presently utilized for tool bodies of this type.

In operation for removal of nails, a user chooses a drive pin 47 having a diameter slightly larger than that of the largest of nails to be driven at that time and installs it in tool housing 23 at chamber 45. The user then unscrews retainer 39 from base 35 and replaces guide element 33 as appropriate for the selected drive pin 47 with the appropriate nose for the selected driver with compression spring 65 in place about element 33 adjacent end 41. When retainer 39 is resecured, compression spring 65 forces the guide element 33 to its fully extended position thus providing a barrier between objects and driver pin 47 in case of accidental activation of the tool.

To prepare for nail removal, if the tool includes the features shown in FIGS. 8 through 14, guide element 33 is rotated about its longitudinal axis until the desired marking is aligned with member 83. The tool is then connected to its means of motive power and the point of a bent nail is selected and inserted into internal passage 53 of guide element 33. Using the tool, the nail is bent straight if necessary. Trigger 27 is pulled thus activating the actuator assembly and the nail point is driven closer to the surface of the host material. Guide element 33 is again placed over the nail and element 33 is pressed hard against the host material surface causing retraction of element 33 (to the extent allowed if the tool includes the features shown in FIGS. 8 through 14). The actuator assembly is again activated driving the nail into the host material, drive pin 47 following the nail into the hole created.

When no nail point is easily accessible, the tool can be used to drive a nail through the host material by impacting the nail head. Where provided, the user can reset member 83 to allow a greater extent of pin 47 protrusion from guide element 33. Operations can be repeated as often as necessary to complete nail removal. Where nails of different size are encountered, the tool can be reconfigure with a different driver assembly (pin 47 and guide element 33) for more effective and productive operations, and (when provided) various retraction lockout, free retraction travel and/or no retraction options can be exercised.

What is claimed is:

1. A powered impact tool utilized at only one side of a host material for removal of various sized fasteners from the host material comprising:

a tool housing including a chamber operatively associated with an actuator assembly, wherein said chamber is a cylinder; and interchangeable driver assemblies including a plurality of interchangeable drive pins and a guide portion having a bore segment and a plurality of interchangeable guide elements each selectively adapted for use with a different one of said plurality of drive pins, each of said plurality of drive pins having first and second ends, said first ends of said plurality of drive pins each configured as a piston slidably movable in said cylinder, said second ends each having a substantially constant diameter selectively adapted for use in removing various sized fasteners and with each of said second ends having at least one of a different diameter and a different length from any other second end of said plurality of drive pins, any selected one of said plurality of drive pins mountable with said first end thereof in said chamber of said tool housing and movable therein responsive to said actuator assembly for impacting a fastener to be removed, said guide portion releasably maintained at said tool housing and in communication with said chamber, a selected one of said plurality of guide elements slidably mountable through said bore segment for receipt therethrough of said second end of said selected one of said plurality of drive pins, said guide elements slidable into and out of said bore segment of said guide portion independent of operation of said actuator assembly.

2. The tool of claim 1 wherein said guide portion includes a mount releasably maintained at said housing in communication with the chamber thereof, said guide elements each having an elongate central passage therethrough, different central passages of different ones of said guide elements having at least one of a different diameter and a different length.

3. The tool of claim 2 wherein said elongate central passage of each of said selectively adapted guide elements has a length adapted to prevent protrusion therefrom of said second end of said selected drive pin for which it is adapted upon activation of said actuator assembly when not positioned against the host material.

4. The tool of claim 3 wherein said guide element is biased toward a fully extended position from said bore segment relative to said tool housing, said guide element slidable between said fully extended position and positions retracted within said bore segment toward said tool housing.

5. The tool of claim 1 wherein said guide portion includes a mount base releasably maintained at said housing and a retainer having said bore segment therethrough releasably securable to said mount base, said selected one of said plurality of guide elements receivable at one end thereof at said mount base and through said retainer.

6. The tool of claim 1 wherein said guide element is cylindrical with a primary external diameter and wherein said guide portion further includes a retainer having said bore segment thereat for receipt therethrough of said guide element, said internal bore having a secondary bore segment, said bore segment having a diameter selected for slidable receipt and guidance of said guide element along said primary external diameter, said secondary bore segment larger than said bore segment and adjacent said tool housing when said guide portion is secured thereat, said guide element having an external shoulder with a diameter selected for slidable receipt and guidance in said retainer at said secondary bore segment.

7. Interchangeable driver assemblies for a powered impact denailing apparatus, each assembly adapted for removal of selected driven fasteners of particular sizes or characters from a host material, the denailing apparatus having a chamber defined by a cylindrical wall and operatively associated with an actuator assembly, said assemblies comprising:

a plurality of interchangeable drive pins each having a piston configured end portion for sealingly engaging the cylindrical wall of the chamber and a driver end portion having at least one of a different diameter and a different length from any other driver end portion of said plurality of drive pins, a selected one of said plurality of drive pins mountable in the chamber of the denailing apparatus for movement therein responsive to the actuator assembly; and a plurality of interchangeable guide elements each selectively adapted for use with a different one of said plurality of drive pins, a selectively adapted one of said plurality of guide elements slidably receivable at the denailing apparatus in communication with the chamber thereof for receipt therethrough of said driver end portion of said selected one of said plurality of drive pins, said selected one of said plurality of drive pins and said one of said plurality of guide elements movable independent of one another, said one of said plurality of guide elements configured and received at the denailing apparatus for slidable movement independent of operation of the actuator assembly;

wherein a different selected one of said plurality of drive pins together with a different selectively adapted one of said plurality of guide elements may be installed at the denailing apparatus when selected fasteners of a different size or character are encountered.

8. The interchangeable driver assemblies of claim 7 further comprising a guide mount releasably maintainable at the denailing apparatus in communication with the chamber thereof, any selectively adapted one of said plurality of guide elements receivable at said guide mount.

9. The interchangeable driver assemblies of claim 8 wherein said guide elements are each slidably retainable at said guide mount and biased toward a fully extended position relative to the guide mount, each of said guide elements slidable between said fully extended position and positions retracted into said guide mount.

10. The interchangeable driver assemblies of claim 9 where said guide elements each includes an external intermediate shoulder slidable in said guide mount and wherein said guide mount includes an internal shoulder, said assemblies further comprising a spring mounted about any selected one of said guide elements for location between said shoulders when assembled for biasing said guide element to said fully extended position.

11. The interchangeable driver assemblies of claim 9 wherein each of said guide elements include a central passage having a length adapted to prevent protrusion therefrom of said driver end portion of a selected one of said drive pins for which it is adapted when not positioned against the host material.

12. The interchangeable driver assemblies of claim 8 wherein said guide mount includes a mount base releasably maintainable at the denailing apparatus and a retainer releasably securable to said mount base, any selected one of said plurality of guide elements receivable at one end thereof at said mount base and through said retainer.

13. A denailing tool for removal of nails from a host material comprising:

a housing including a chamber operatively associated with an actuator assembly;

a guide portion including a mount releasably maintained at said housing in communication with the chamber thereof and a guide element having an elongate central passage therethrough, said guide element receivable through said mount and slidably retained thereat, said guide element slidable independent of operation of said actuator assembly between a fully extended position protruding from said mount and a retracted position within said mount and biased toward said fully extended position; and a drive pin having first and second ends, said first end positionable in said chamber of said housing and movable therein responsive to activation of said actuator assembly and said second end receivable at said guide portion and protrusible through and from said elongate passage of said guide element when said guide element is moved to said retracted position and said actuator assembly is activated.

14. The denailing tool of claim 13 further comprising at least one additional drive pin interchangeable with said drive pin in said tool, each of said drive pins having an end portion with at least one of a different diameter and a different length from any other drive pin end portion.

15. The denailing tool of claim 13 further comprising at least one additional guide element interchangeable with said guide element at said mount, each of said guide element selectively adapted for use with a nail of particular size or character.

16. The denailing tool of claim 13 wherein said guide element includes at least one external longitudinal groove of a particular length and wherein said mount includes a manipulable member selectively positionable relative to said guide element and said groove thereof, wherein said guide element and said manipulable member may be positioned for relative slidable movement in said groove of a portion of said manipulable member to delimit extent of travel between said fully extended position and said retracted position.

17. The denailing tool of claim 13 wherein said mount includes mount base releasably maintained at said housing and a retainer releasably securable to said mount base, said guide element receivable at one end thereof at said mount base and through said retainer.

18. The denailing tool of claim of 17 wherein guide element includes an external intermediate shoulder slidable in said retainer and wherein said mount base includes an internal shoulder, said guide portion of said tool further comprising a spring mounted about said guide element for location between said shoulders when assembled for biasing said guide element to said fully extended position.

19. The denailing tool of claim 17 wherein said guide element is cylindrical with a primary external diameter, said retainer having an internal bore for receipt therethrough of said guide element, said internal bore having first and second bore segments with said first bore segment having a diameter selected for slidable receipt and guidance of said guide element along said primary external diameter, said second bore segment larger than said first bore segment and adjacent said mount base when said retainer is secured thereat, said guide element including an external annular shoulder having a diameter selected for slidable receipt and guidance in said retainer at said second bore segment.

* * * * *